United States Patent [19]

Takenoya et al.

[11] Patent Number: 5,048,435

[45] Date of Patent: Sep. 17, 1991

[54] DEVICE FOR A SEWING MACHINE HAVING A ZIGZAG STITCHING MECHANISM AND AN EMBROIDERING MECHANISM

[75] Inventors: Hideaki Takenoya; Fumiyuki Mishima, both of Tokyo, Japan

[73] Assignee: Janome Sewing Machine Co. Ltd., Tokyo, Japan

[21] Appl. No.: 441,161

[22] Filed: Nov. 27, 1989

[51] Int. Cl.[5] ..... D05B 7/00; D05B 3/00

[52] U.S. Cl. ..... 112/168; 112/103; 112/465

[58] Field of Search ..... 112/103, 168, 453, 462–465, 112/157

[56] References Cited

U.S. PATENT DOCUMENTS

| | | | |
|---|---|---|---|
| Re. 24,370 | 10/1957 | Harris | 112/465 |
| 3,096,737 | 7/1963 | Bono | 112/103 X |
| 4,135,462 | 1/1979 | Brown | 112/453 |
| 4,159,003 | 6/1979 | Johnson et al. | 112/453 |
| 4,164,192 | 8/1979 | Herr et al. | 112/453 |
| 4,195,581 | 4/1980 | Ohara | 112/103 |
| 4,386,573 | 6/1983 | Davidson et al. | 112/453 X |

FOREIGN PATENT DOCUMENTS

| | | | |
|---|---|---|---|
| 2120874 | 6/1987 | Japan | 112/157 |

*Primary Examiner*—Werner H. Schroeder
*Assistant Examiner*—Sullivan C. Prak
*Attorney, Agent, or Firm*—Michael J. Striker

[57] ABSTRACT

A switching device is provided for a sewing machine for switching operation of the sewing machine from a zigzag stitching to embroidering or vice versa. The switching device comprises a rotatable disc fixedly mounted on an output shaft of a stepping motor and a sliding member that movably connects one end of a transmission rod via a pin, the other end of which is connected to a needle bar supporter or a fabric feed device, with the rotatable disc so that the one end of the transmission rod is movable between a first position on the rotatable disc which coincides with the center of rotation of the rotatable disc, and a second position on the rotatable disc which is spaced apart from the center of rotation of the rotatable disc. The switching device further comprises a stopper that engages a stub projecting from the transmission rod, in the first position of the one end of the transmission rod on the rotatable disc, and a mechanism for converting rotational movement of the stepping motor output shaft to movement of an embroidering frame in an X- or a Y-directions, dependent on whether the other end of the transmission rod is connected to the needle bar supporter or the fabric feed device, respectively, when the stopper engages the stub.

3 Claims, 8 Drawing Sheets

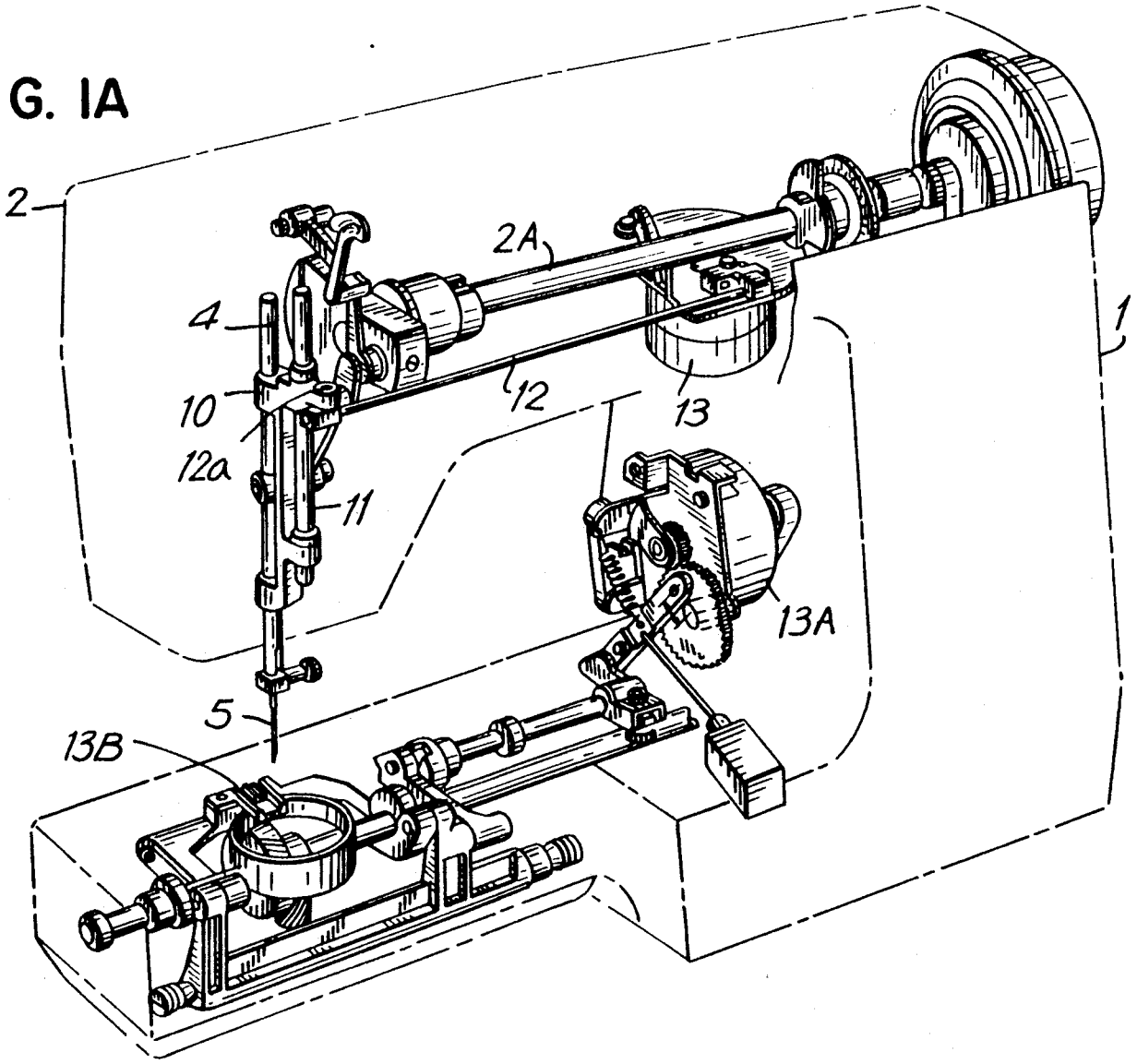
FIG. IA

DEVICE FOR A SEWING MACHINE HAVING A ZIGZAG STITCHING MECHANISM AND AN EMBROIDERING MECHANISM

BACKGROUND OF THE INVENTION

1. Field of the Invention

This invention relates to a sewing machine having a zigzag stitching mechanism and an embroidering mechanism, and a device for switching from a sewing operation with either one of these mechanisms to the other.

2. Description of the Related Prior Art

In a conventional sewing machine including a zigzag stitching mechanism and an embroidering mechanism within a machine frame, with respect to the zigzag stitching mechanism, two stepping motors have been employed, respectively, for controlling the swing amplitude of a needle bar and controlling fabric feed, and with respect to the embroidering mechanism, two stepping motors have been employed respectively for driving an embroidering frame in an X-direction and in a Y-direction. Therefore, the narrow interior within the machine frame has been almost occupied with these stepping motors, and consequently other mechanisms had to be complicated, inevitably, with increasing the weight of the mechanisms bringing inconveniences in the production and the users' handlings.

SUMMARY OF THE INVENTION

According to the present invention, a single stepping motor is used, by switching, to control the swing amplitude of the needle bar of the zigzag stitching mechanism and to control movement of an embroidering frame in the X-direction of the embroidering mechanism, and on the other hand, a single stepping motor is used, by switching, to control the fabric feed of the zigzag stitching mechanism or to control movement of the embroidering frame in the Y-direction of the embroidering mechanism. Thus, the number of the stepping motors is reduced from four to three to simplify the mechanisms and decrease the weight thereof.

In order to use both or at least one of the two stepping motors for controlling the swing amplitude of the needle bar of the zigzag stitching mechanism and controlling the embroidering frame in the X-direction as well as the other of the two stepping motors for controlling the fabric feed of the zigzag stitching mechanism and controlling the embroidering frame in the Y-direction, this invention is characterized in that a rotatable disk is attached on the rotating shaft of a stepping motor and a sliding member is supported on the disc and moves between the rotating center of the rotatable disk and a position spaced apart from the rotating center. A transmission rod is provided such that it is connected at one end thereof with the sliding member and at the other end to a needle bar supporter or a fabric feeding device. A stopper is provided such that, during embroidering, it is engaged with a shaft portion fixed to the transmission rod so as to fix the transmission rod, and, during zigzag stitching, it is disengaged from the shaft portion so as to release the transmission rod. A device is provided which switches the rotation of the stepping motor to an angular region of transmitting rotation of the stepping motor to the needle bar supporter or the fabric feeding device, and to an angular region of transmitting rotation to the embroidering frame when the fabric feeding device is switched off.

The present invention both as to its construction so to its mode of operation, together with additional objects and advantages thereof, will be best understood from the following detailed description of the preferred embodiments with reference to the accompanying drawings.

BRIEF DESCRIPTION OF THE DRAWINGS

FIG. 1A is the same view as shown in FIG. 1 but with a portion of the cover removed;

DETAILED DESCRIPTION OF THE PREFERRED EMBODIMENTS

Figure 1:
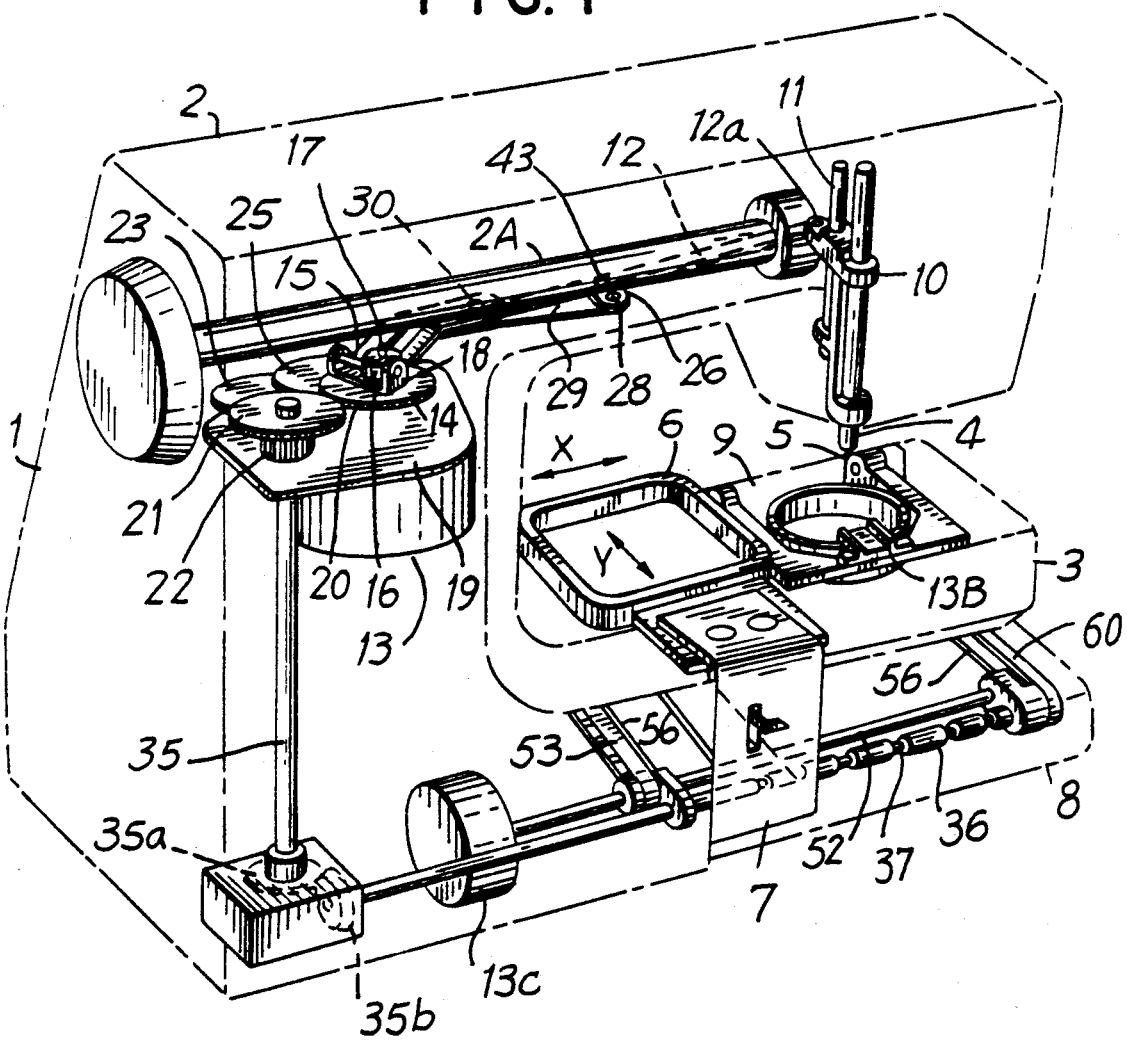
FIG. 1 is a perspective view of a sewing machine according to the invention.

A reference will be made to the structure of the first embodiment of the invention, in which the machine frame 1 is composed of a frame arm 2 and a frame bed 3. A drive shaft of a motor (not shown) is rotatably supported within the frame arm, and a needle bar 4 is vertically reciprocated by the drive shaft. A thread loop catching device and a fabric feeding device 13*b* are disposed within the frame bed 3. A locked stitch is formed at a desired feed pitch with an upper catching device, the fabric feeding device and the needle bar 4, the upper thread being carried by a needle 5 attached to the lower end of the needle bar, and the lower thread being held within the thread loop catching device.

An embroidering frame 6 is supported detachably on an embroidering frame driving part 7. The driving part 7 is moved in the X-direction or the Y-direction perpendicular to the X-direction by a drive mechanism (not shown) of the embroidering frame provided with a frame 8, and thus a fabric spread over the embroidering frame 6 is formed with patterns.

During an embroidering operation, a feed dog of the fabric feed device is lowered below a needle plate 9 and thereby disengaged from the operation which is carried out automatically by an electronic control device fed with a given set of embroidering data. The embroidering data may automatically carry out the operation by being input into a control device (not shown) electrically connected to the sewing machine of the invention.

A switching mechanism for switching operation from zigzag stitching to embroidering is explained hereinafter. A needle bar supporter 10 is supported on the frame arm 2 and is rotatably mounted on a shaft 11 while the needle bar 4 is movable vertically at one end of the supporter 10. A transmission rod 12 is connected at its one end 12*a* to the other end of the needle bar support 10. The other end of the transmission rod 12 is connected to a sliding member 16 via a pin 17. The sliding member 16 is slidable on a pin shaft 15 mounted on a rotatable disc 14 secured on a rotation shaft 48 of the stepping motor 13 (see FIGS. 2 and 3).

The pin shaft 15 is held by plate 18 while plate 18 is supported on a rotatable disc 14. The axis of the pin shaft 15 passes through the rotation center of the disc 14.

Figure 2:
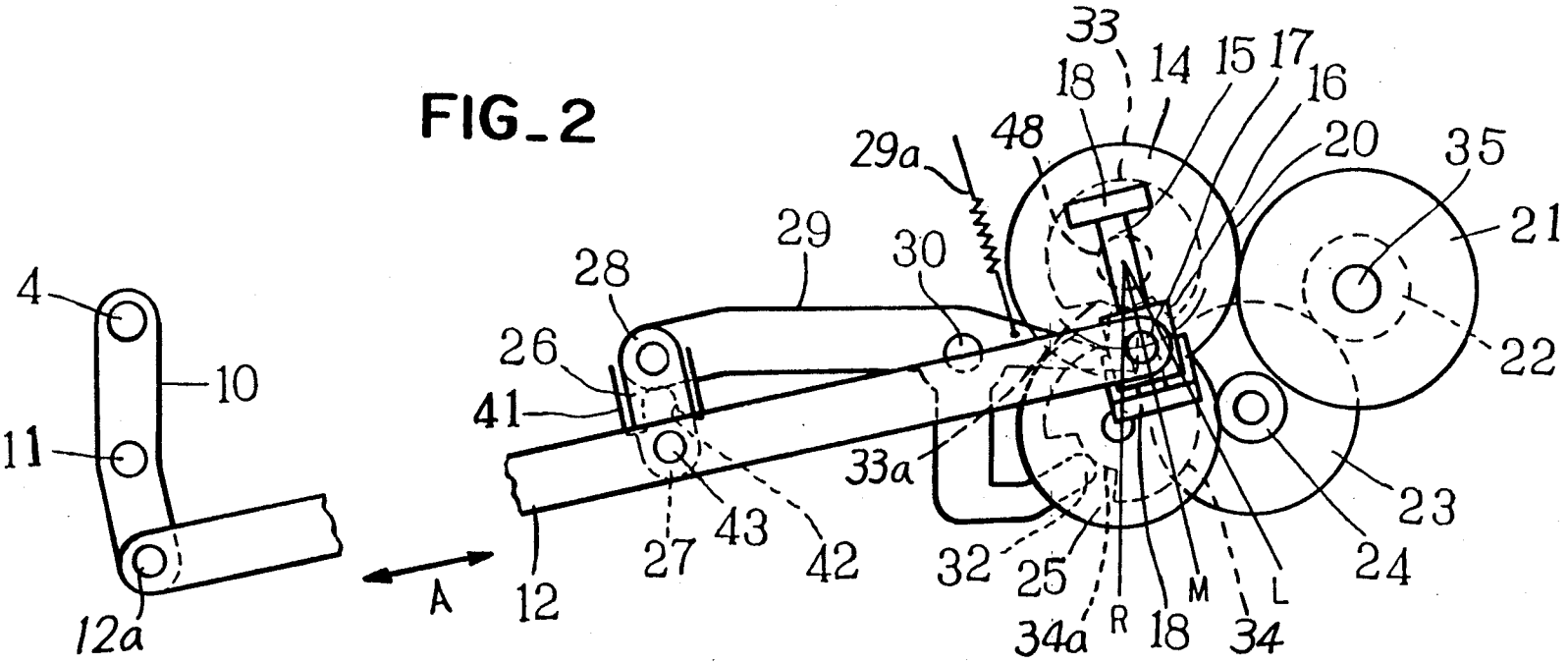
FIG. 2 is a plan view of a switching device according to the invention in a zigzag stitching mode thereof.
Figure 3:
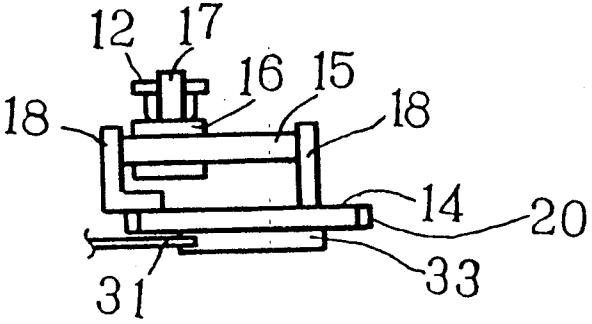
FIG. 3 is a cross-sectional view of an essential part of the switching device shown in FIG. 2.

During a zigzag stitching operation, the sliding member 16 is positioned as shown in FIG. 2 while the needle bar 4 is driven to reciprocate vertically by the drive shaft of a needle bar reciprocating motor (not shown) and the needle bar supporter 10 is rotated via the transmission rod 12.

The stepping motor 13 is carried on a motor supporting plate 19 fixed to the arm 2. Rotatably supported on the motor supporting plate 19 are a gear 21 in mesh with a gear 20 formed in the outer circumference of the rotatable disc 14, a small gear 22 coaxially integrated with the gear 21, a gear 23 in mesh with the small gear 22, a small gear 24 coaxially integrated with the gear 23, and a gear 25 in mesh with the gear 24.

The reference numeral 26 designates a guide link whose one end 27 is connected to the transmission rod 12 and the other end 28 is connected to one end of another guide link attached to one end of a plate 29 which is rotatably supported on a stationary shaft 30 fixed to the motor supporting plate 19, and plate 29 is provided with two branches, namely, a first follower 31 and a second follower 32 at its other end.

The first follower 31 engages a first cam member 33 formed as a bottom portion of the rotating disc 14. The second follower 32 engages a second cam member 34 formed as a top portion of a gear 25 facing the bottom portion of the rotatable disc 14.

A transmission shaft 35 is rotated together with the gears 21, 22. The transmission shaft 35 is connected with a lead screw shaft 36 (see FIG. 5*a*) by bevel gears 35*a* and 35*b*. The screw shaft 36 serves as a follower for driving the embroidering frame in the X-direction. The lead screw shaft 36 is formed with a lead groove 37 circumventing in a spiralling manner from one end of the shaft 36 to its other end and with a stopping groove 38 at an end of the lead groove 37. The grooves 37, 38 are engaged with the stopping pin 40 of the embroidering frame driving carriage 39.

Figure 5:
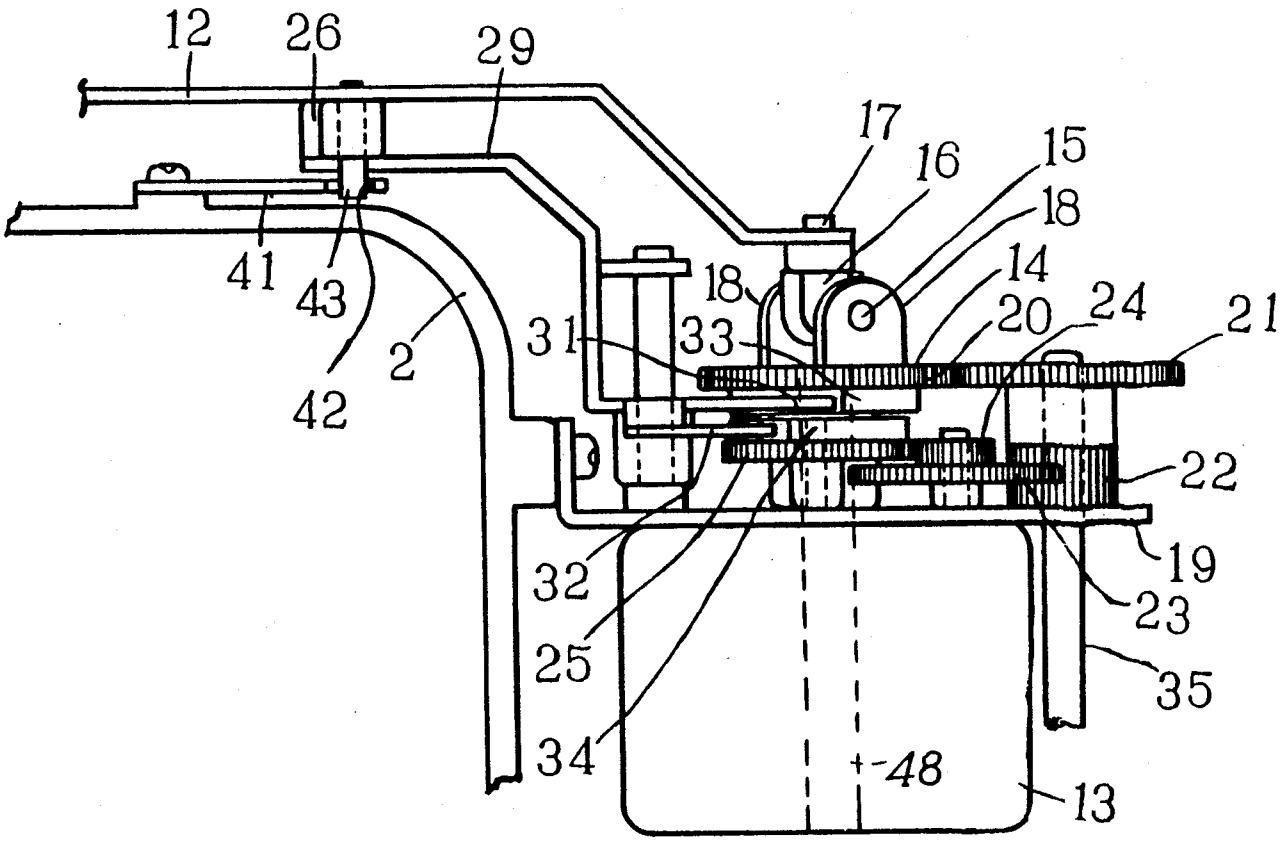
FIG. 5 is a front view of the switching device when it is in the zigzag stitching mode shown in FIG. 2.
Figure 5A:
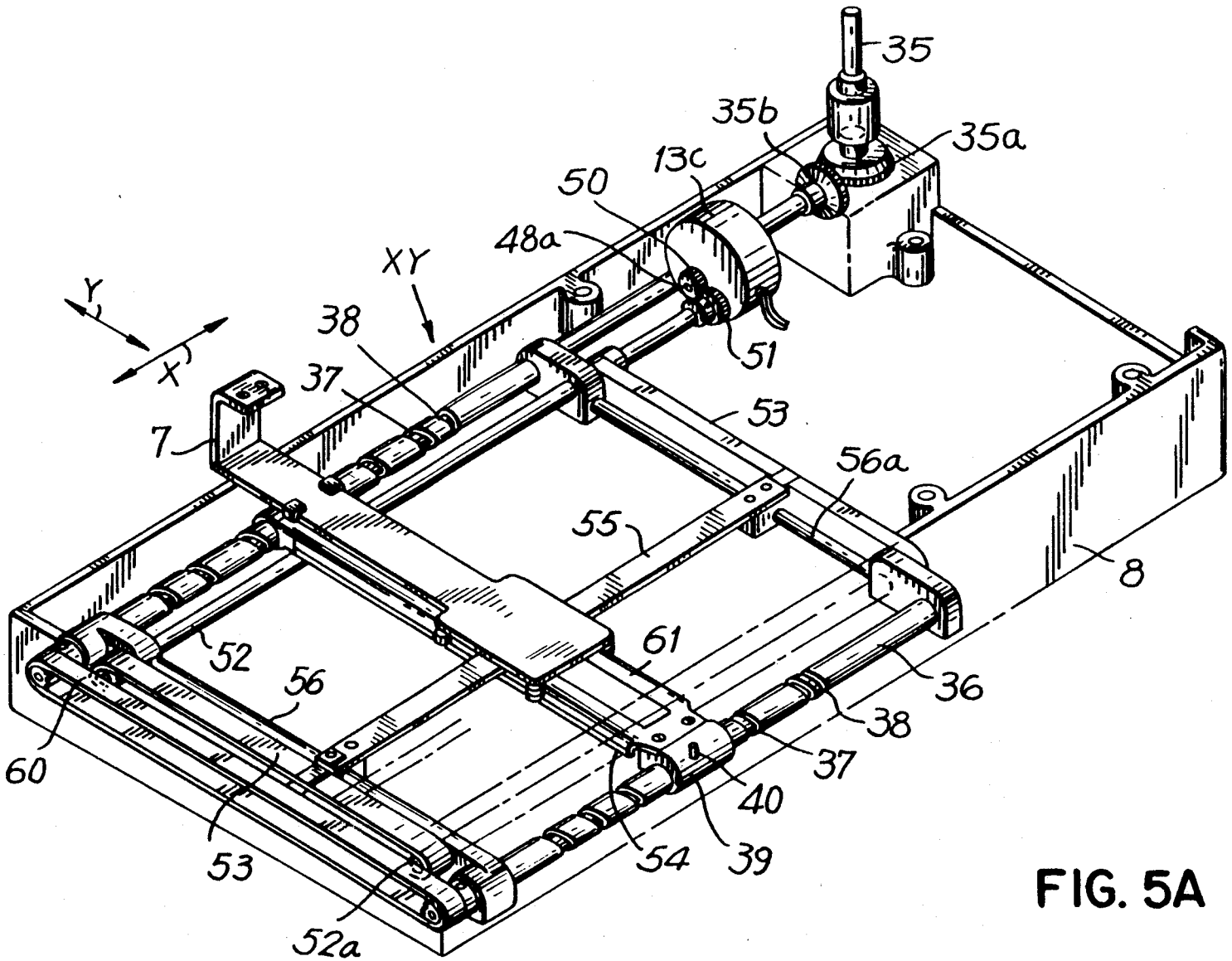
FIG. 5A is an perspective view showing movement of carriages in X-and Y-directions.

The other end of the drive shaft 36 is connected to one end of another rotatable drive shaft 36 of a transmission belt 60. The another drive shaft 36 is arranged in parallel with and spaced from the first drive shaft 36 and also has a spiral groove 37 formed thereon which is terminated with the lead groove 38 at one end thereof. The drive shafts 36 are provided to move the carriage 39 in the direction X which has opposite ends each held in slide engagement with each of the drive shafts 36. As shown in FIG. 5A, each end of the carrier 54 has a pin 40 held in engagement with each of the spiral grooves 37, so that the carriage 39 can move along the drive shafts 36 in the X-direction when the stepping motor 13 is driven.

A third stepping motor 13C is provided for moving the carriage 61 in Y-direction. The stepping motor 13C has a drive shaft gear 48*a* having a gear 50 secured thereto, which is in mesh with a gear 51 secured to one end of the transmission shaft 52 which is arranged in parallel with the drive shaft 36*a* and is rotatably held in the frame 8. The transmission shaft 52 has the other end connected to one end of another transmission shaft 52*a* by a belt 53, the transmission shaft 52*a* being arranged in parallel with the transmission shaft 52 and is rotatably held in the frame 8. The transmission shaft 52*a* has the other end connected to the opposite transmission shaft 52 by another belt 53*a*. A second carriage 55 has opposite ends each secured to each of the transmission belts 53, 53*a* and also held in slide engagement with each of the guide shaft 56, 56*a* which are arranged in parallel with and spaced from each other between and perpendicular to the transmission shafts 52, 52*a*. It is therefore apparent that the carriage 55 will move along the guide shafts 56, 56*a* in Y-direction when the stepping motor 13C is driven.

The drive part 7 is mounted on the first carrier 54 and is slidably movable in the Y-direction. Further the drive part 7 is mounted on the second carriage 55 and is slidably movable in the X-direction but is prevented from moving in the Y-direction relative to the carriage 55. It is therefore apparent that the composite movements of the first and second carriers 54, 55 will move the fabric holding hoop 6 to the optional positions with respect to the vertically reciprocating needle 5 in the embroidery pattern stitching mode.

Figure 6:
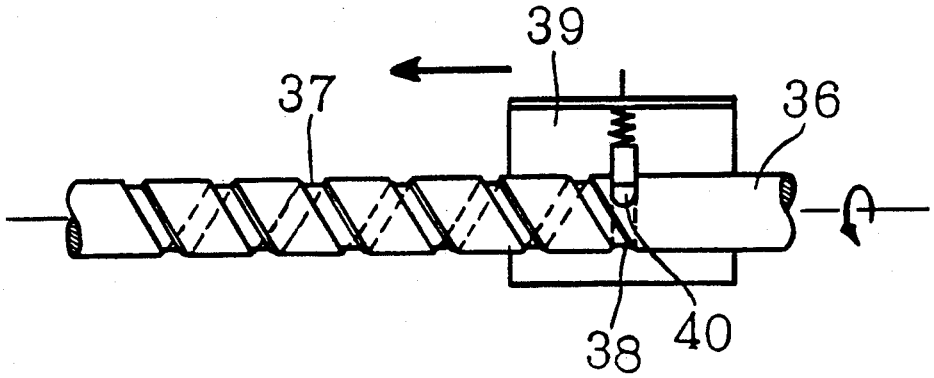
FIG. 6, is a front view of an essential part of the switching device according to the invention.

Now if the zigzag pattern stitching mode is selected, the stepping motor 13 is rotated, transmission rod 12 is released by hand from the stopper 41 as shown in FIG. 2 and simultaneously return the carriage 54 to a rest position as shown in FIG. 6 through the gears 14, 21, the vertical shaft 35, the bevel gears 35*a*, 35*b*. Precisely the carriage 54 is moved in the X-direction until the pins 40 of the carriage come into engagement with the lead grooves 38 respectively.

Figure 7:
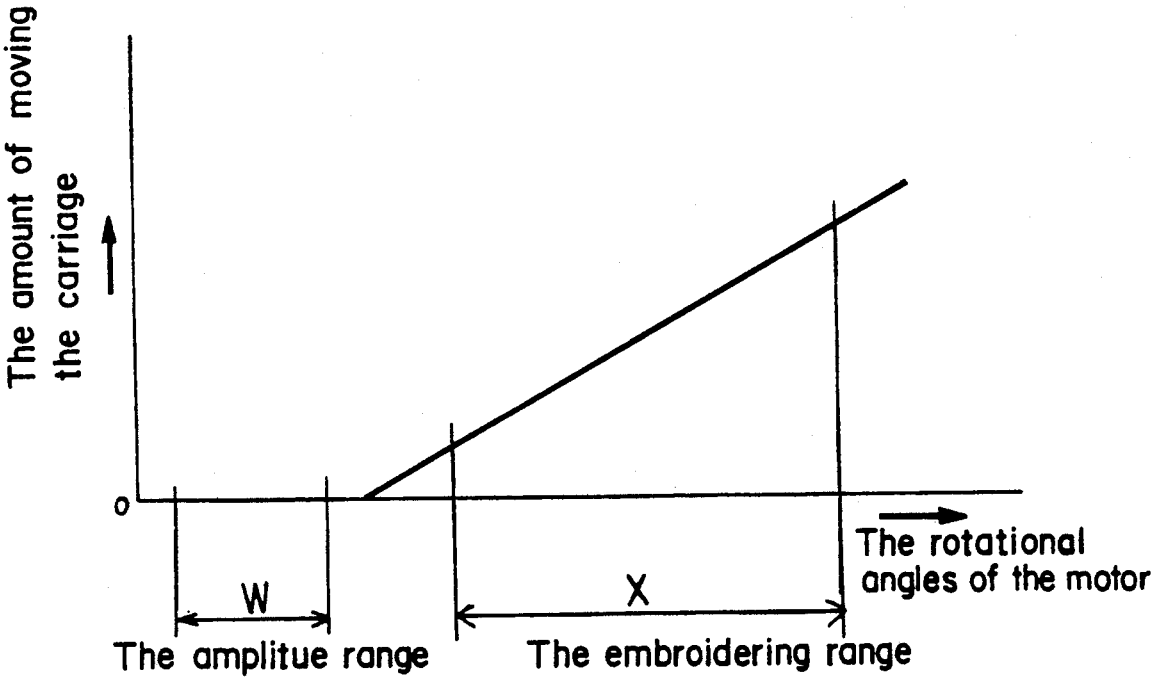
FIG. 7 is a view of developing rotational angles of the stepping motors of the invention.

In the zigzag pattern stitching mode, the needle position swing amplitude is controlled by the stepping motor 13 within the maximum control range R-L which is within the range defined by the recessed part 33*a* of the cam 33 while the lead groove 38 defining the range W in FIG. 7 wherein Z is an indefinite range corresponding to a location of connection between the stopping groove 38 and the spiral groove 37 as shown in FIG. 6 and AM is a substantial moving amount of the carriage 54 in the X-direction in FIG. 5A. Since BM corresponds to the range of the stopping groove 38, the carriage 54 will not move in this range.

It is therefore apparent that the carriage 54 will not move in the X-direction in the zigzag pattern stitching mode. A fabric to be sewn is transported relative to the needle 5 by the feed device 13B which is operated by the stepping motor 13A as shown in FIG. 1A. Since the stepping motor 13C remains inoperative in this case, the carriage 55 will not move in the Y-direction and need not be particularly discussed herein.

A stopper member 41 is secured to the frame arm 2, which is formed with a recess 42 for detachably holding a stub 43 provided as a connection between the transmission rod 12 and a guide link 26.

A second embodiment of the switching mechanism of the invention is explained hereinafter with reference to FIGS. 8 and 9. A connection link 44 has one end 45 rotatably connected to the rotatable disc 14 at a position of a connecting shaft 46, and the other end 47 rotatably connected to the other end of the transmission rod 12. The distance between the shafts 47 and 46 of the connection link 44 is equal to the distance between the rotation center 0 of the rotatable disc 14 and the implanting position of the connecting shaft 46 on the rotatable disc.

Figure 8:
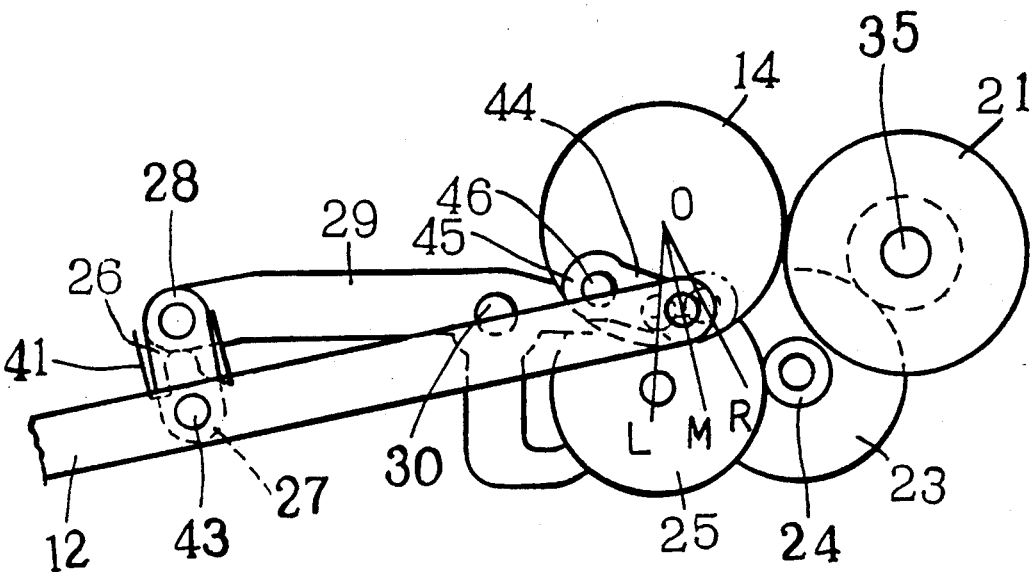
FIG. 8 is a plan view of another embodiment of a switching device according to the invention in a zigzag stitching mode thereof.

When zigzag stitching is selected in accordance with the zigzag stitching data input into the electronic control device and the switching mechanism is moved to a position shown in FIG. 2 or 8, the stub 43 of the transmission rod 12 is moved out of the recess 42 of the stopper 41, and the first follower 31 of the guide link 29 is engaged with a recess 33*a* of the member 33 having a convex base surface extending toward both sides of the recess, while the second follower 32 is engaged with the similar recess of the second cam member 34. The sliding member 16 connected to the end of the transmission rod 12, or the other end 47 of the connection link 44 (see FIG. 8) is spaced apart from the rotating center 0 on the rotatable disc 14 and from the shaft 48 of the stepping motor, and is prevented from sliding back by the first follower 31. The follower 31 is biased into engagement with the recess 33*a* by a tension spring 29*a*. When the stepping motor 13 is reciprocatingly rotated under this condition in response to the controlling data from the control device, the transmission rod 12 is moved reciprocatingly in the directions shown by arrows A, so that the needle bar supporter 10 is rotated around the shaft 11. Thus, the sewing machine carries out ordinary stitchings including the zigzag stitching by the cooperation of the needle bar, the thread loop catching device, and the fabric feed device.

When the stopping pin 40 is engaged in the stopping groove 38 of the lead screw shaft 36, the embroidering frame drive part 30 does not drive the embroidering frame 6, even if the lead screw shaft 36 is rotated in a certain allowable range only.

Figure 4:
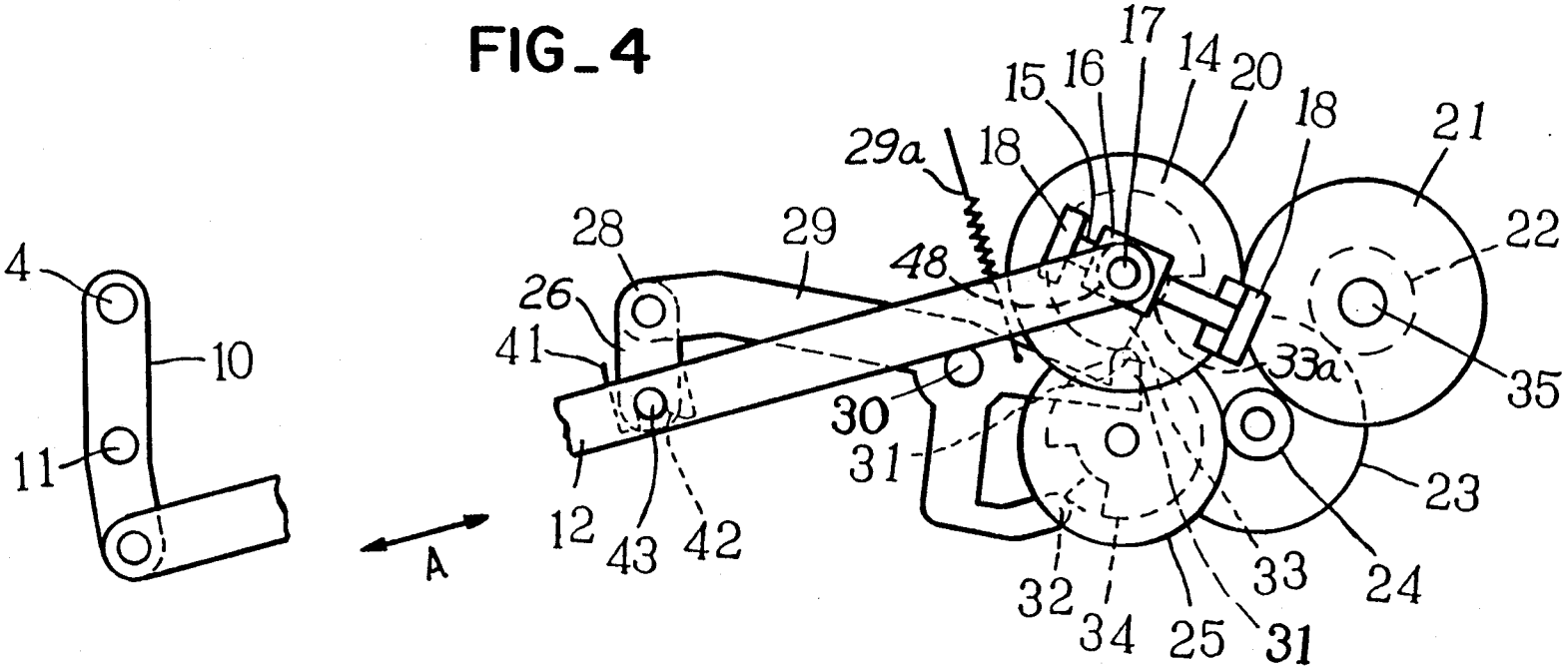
FIG. 4 is a plan view of the switching device of FIG. 2 in an embroidering mode thereof.
Figure 9:
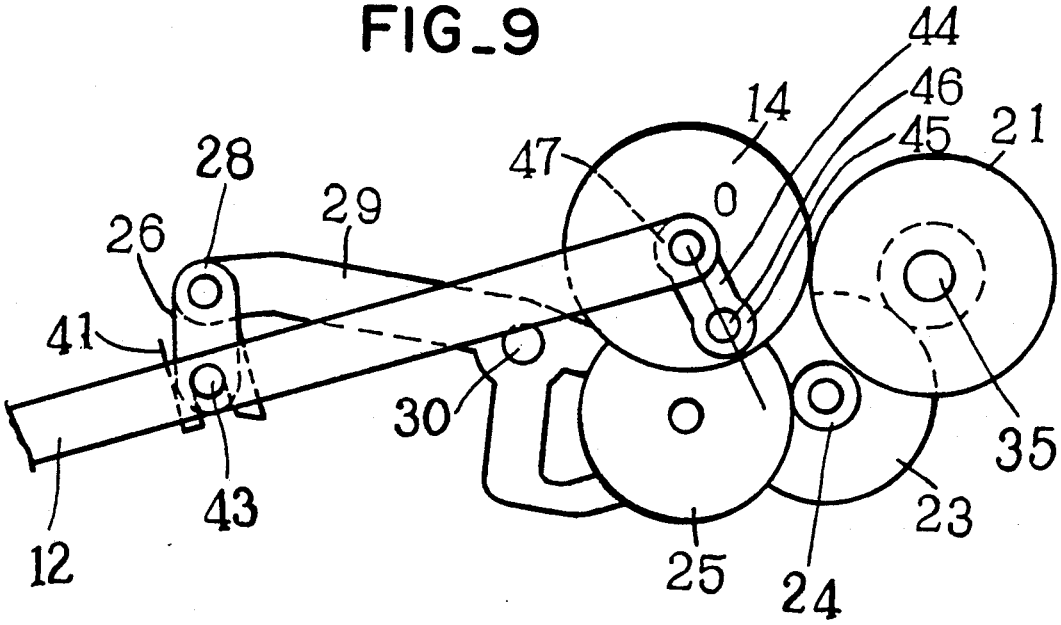
FIG. 9 is a plan view of the switching device shown in FIG. 8 but in an embroidering mode thereof.

When the switching mechanism, upon selection of the embroidering operation in accordance with the controlling data, is moved to a position shown in FIG. 4 or 9, the transmission rod 12 is prevented from the movement in directions of arrows A, since the stub 43 of the transmission rod 12 is engaged in the recess 42 of the stopper 41. At the same time, the first follower 31 of the guide link 29 contacts the convex surface outside of the recess of the first cam member 33, and the second follower 32 contacts the convex surface of the second cam member 34, so that the sliding member 16 connected to the end of the transmission rod 12 slides on the pin shaft 15. According to the second embodiment, since the other end 47 of the connection link 44 is moved to a position near the rotating center 0 of the disc 14, the position of the needle bar supporter 10 is secured, because the reciprocating motion of the transmission rod 12 is not affected by rotation of the disc 14. But the lead screw shaft 36 is rotated, and the stopping pin 40 of the embroidering frame drive part 39 is engaged in the lead groove 37 of the lead screw shaft 36, so that the controlled rotation of the transmission shaft 35 is transmitted to the lead screw shaft 36, so that the embroidering frame 6 is movable in the X-direction.

In summary, when the embroidery stitching mode is selected, the stepping motor shaft 48 is rotated at an angular position 233° to bring the cam follower 31 of the lever 29 into engagement with the larger radius part of the cam 33. The lever 29 is therefore turned clockwise to bring the pin 43 of the rod 12 in engagement with the recessed part 42 of the stopper 41 to thereby prevent the rod 12 from the longitudinal reciprocation in the direction A so that the needle 4 is fixedly located at a predetermined position.

In the meantime, the center pin 17 of the slide member 16 at the end of the transmission rod 12 is moved to the position which is axially in alignment with the stepping motor shaft 48 so that the rod 12 is prevented from the longitudinal reciprocation if the stepping motor shaft 48 is rotated. It is however noted that embroidery patterns in the embroidering stitching mode may be large scaled compared with patterns made in the zigzag stitching mode by the needle 5 swingable within the maximum range R–L (7 mm at most), because the embroidery patterns are formed by moving a fabric relative to vertically reciprocating needle (not zigzag movement), the fabric being held on a hoop 6 (or a fabric holder) which is connected to an X-Y driver 7, the groove frame having a side length of more than 160 mm in this embodiment.

Since the stepping motor shaft 48 is rotated many times actually five complete rotations (360°×5) at most is the embroidering pattern stitching mode in the range X in FIG. 7, the cam follower 31 of the lever 29 will drop into the recessed part 33*a* of the cam 33 so many times and consequently the lever 29 will swing to release the transmission rod 12 from the stopper 41 each time the cam follower 31 engages the recessed part 33*a* of the cam 33. In order to eliminate such adverse effect, a second follower 32 of the lever 29 and a second cam 34 are provided, the second cam being rotated at a predetermined speed reduction ratio from the gear 41 via a series of the transmission gears 21 to 25.

In short, the second cam 34 is so designed as to have a larger radius part and a smaller radius part 34*a*. The larger radius part engages the second cam follower 32 while the first cam follower 31 is in the range 33*a* of the smaller of the first cam 33 to thereby hold the lever 29 at the fixed position as shown in FIG. 4. The smaller radius part 34*a* of the second cam 34 is designed to engage the second cam follower 32 if the zigzag pattern stitching mode is selected when the first follower 31 is in engagement with the small radius part 33*a* of the cam 33.

The possible distinguishing patterns which are made possible by the invention, will be discussed below with reference to FIG. 7 and other figures. If the sewing machine is switched to the zigzag stitch mode by manually operating a switch (not shown), the stepping motor shaft 48 is rotated in accordance with a so set program to an initial position 0° as shown in FIG. 7, and then further rotated about 3° and is stopped. This is the same when a power source is turned on.

In this connection, the cam follower 31 of the lever 29 is pressed against the recessed part 33*a* of a cam 33 by a tension spring 29*a*, and consequently a lever 29 is turned counterclockwise around the fixed pin 30 to thereby disengage the pin 43 of the rod 12 from the recess part 42 of a stopper 41 which is secured to the arm frame 2, the pin 43 being connected to the end 28 of the lever 29 by a link 26, that is, the transmission rod 12 is turned clockwise around an axis pin 12*a* to thereby release the rod 12 from the stopper 41.

In the meantime, a slide member 16 is displaced to one end of a laterally extended guide pin 15 where a slide member 16 is away from the stepping motor shaft 48 as shown. The slide member 16 is fixedly positioned there because the cam follower 31 of the lever 29 engages the smaller constant radius part 33*a* of the cam 33.

More precisely, if the cam 33 is rotated within the maximum range R–L corresponding to the range 3° to 33° in FIG. 7, the lever 29 will not move around the pin 30 and therefore the pin 43 will not move due to the action of the tension spring 29a pressing the follower 31 against the recessed part 33a of the cam 33. Therefore the rotating movement of the motor shaft 48 within the maximum range R–L is correctly transmitted to the needle 5 through the slide member 16, the transmission rod 12 and the swingable needle support 10 while the fabric (not shown) is transported by a fabric feed device 13B operatively connected to a second stepping motor 13A to be controlled thereby as shown in FIG. 1A.

In the zigzag pattern stitching mode, the needle position is controlled by the stepping motor 13 within the maximum control range R–L which is within the range defined by the recessed part 33a of the cam 33 while the lead groove 38 defining the range W in FIG. 7 wherein Z is an indefinite range corresponding to a connection part 38b between the lead groove 38 and the spiral groove 37 as shown in FIG. 6 and AM is a substantial maximum moving amount 80 mm of the carriage 54 in the X-direction in FIG. 5A.

As shown by line L in FIG. 7, the carriage 54 will start to move in the X-direction in the indefinite range Z before the stepping motor 13 is coated to the angular position 233°. However, according to the invention, the embroidery pattern stitching range X starts from the angular position 233° of the motor 13 which is regarded as 0° and extends to an angular position reached by five complete rotations of the motor 13 (360°×5) which correspondings to a maximum moving amount 80 mm of the carriage 54 in the X-direction as shown in FIG. 7.

The present invention is disclosed with the embodiment in which one stepping motor 13 selectively controls the needle position and the X drive part of X-Y drive mechanism while the Y drive part is controlled by another stepping motor.

Therefore it will not be necessary to mention the movement of the second carriage 55 in the Y-direction. It may however be considered that the carriage 55 will move within the maximum range 80 mm in the same manner as the first carriage 54.

It is therefore apparent that the carriage 54 will not move in the X-direction in the zigzag pattern stitching mode. A fabric to be sewn is transported relative to the needle 5 by the feed device 13B which is operated by the stepping motor 13A as shown in FIG. 1A. Since the stepping motor 13C remains inoperative in this case, the carriage 55 will not move in the Y-direction and need not be particularly discussed herein.

With the explanation as mentioned above, it is apparent that the patterns made in the zigzag pattern stitching mode will be limited in size within the maximum needle swinging range R–L (7 mm at most). But the patterns made in the embroidery pattern stitching mode maybe enlarged up to 80 mm in size which corresponds to the maximum range of movement of the carriage 54 or 55 relative to the needle.

The switching device using two stepping motors for controlling the fabric feed in the zigzag stitching and for controlling the Y-directional movement of the embroidering frame has the same structure as the switching device for controlling the swing amplitude of the needle bar and for controlling movement of the embroidering frame in the X-direction.

We claim:

1. A switching device for a sewing machine including a frame having an upper part thereof formed as a frame arm and a lower part thereof formed as a frame bed, a drive shaft rotatably supported in the frame arm, a needle bar reciprocating vertically in accordance with rotation of the drive s aft, a needle bar supporter for holding the needle bar and movably supported in the frame arm, a fabric feeding device movably supported within the frame bed, a stepping motor for controlling one of reciprocating movement of the needle bar supporter and movement of the fabric feedin device and having an output shaft, and a transmission rod having a first end thereof connected to one of the needle bar supporter and the fabric feeding device and a second end thereof connected with the stepping motor for transmitting rotational movement of the stepping motor output shaft into each of the reciprocating movement of the needle bar supporter and the movement of the fabric feeding device for zigzag stitching operation, respective; said switching device at a position close to the second end comprising a rotatable disc having a center of rotation and fixedly supported on an out put shaft of the stepping motor; means for movably connecting the second end of the transmission rod with said rotatable disc so that the second end is movable between a first position on said rotatable disc which coincides with the center of rotation of said rotatable disc and a second position on said rotatable disc which is spaced part from the center of rotation of said rotatable disc; a stub projecting from the transmission rod; a stopper for engaging said stub in the first position of the second end of the transmission rod above rotatable disc, said stopper being disengaged from said stub in the second position of the second end of the transmission rod above said rotatable disc; and means for converting the rotational movement of the stepping motor output shaft into movement of an embroidering frame in an arbitrarily chosen X-direction of Y-direction when the first end of the transmission rod is connected with the needle bar supporter and not with the fabric feed mechanism, and when the second end of the transmission rod is in the first position thereof above said rotatable disc during embroidering operation.

2. A sewing machine comprising a frame having upper part thereof formed as a frame ar, a lower part thereof formed as a frame bed, and a lowest part thereof formed as a frame base; a drive shaft rotatably supported in said frame arm; a needle bar vertically reciprocating in accordance with rotation of said drive shaft; a supporter for supporting said needle bar and pivotally supported in said frame arm; a fabric feeding device movably supported within said frame bed; a first stepping motor for controlling a pivotal movement of said needle bar supporter; a second stepping motor for controlling feeding movement of said fabric feeding device; a transmission rod having a first end thereof pivotally connected to said needle bar supporter and a second end thereof connected with the first stepping motor for transmitting rotational movement of the first stepping motor output shaft into the pivotal movement of said needle bar supporter to thereby control the needle position; a gear disc having a rotation center fixedly supported on the output shaft of said first stepping motor for rotation therewith; means for movably connecting the second end of said transmission rod to said gear disc so that the second end is movable between a first position on said gear disc where the second end is coaxially in alignment with the rotation center and with the output shaft of the first stepping motor, and a second position on said gear disc where the second end is radially spaced apart from the first position; stopper means for engaging said transmission rod of the first position of the second end of said transmission rod on said gear disc, said stopper means being disengaged from said transmission rod in the second position of the second end of the transmission rod on the gear disc; embroidering means provided in said lowest frame base of said sewing machine and including a first embroidering mechanism for transporting a fabric to be sewn in an X-direction, and a second embroidering mechanism for transporting fabric in a Y-direction; a third stepping motor for driving one of said first and second embroidering mechanism to transport the fabric in one of said X- and Y-directions, one of said first and second embroidering mechanisms including a transmission gear for purpose of receiving a driving means; and driving means including a vertical shaft having a first gear secured to an upper end thereof and being in mesh with said gear disc, and a second gear meshing with said transmission gear.

3. A sewing machine as defined in claim 2, further comprising means for moving the second end of said transmission rod between the first and second positions on said gear disc, said moving means including a first cam rotatable with said gear disc at a first selected speed, a second cam rotatable at a second speed reduced by said first cam, and a lever having one end connected with said transmission rod and the other end equipped with first and second followers, the first follower engaging with said first cam and the second follower engaging said second cam, said first cam holding said second end of said transmission rod in the second position on said gear disc via the first follower and said first and second cams cooperating to hold the second end of said transmission rod in said first position on said gear disc.

* * * * *